United States Patent [19]

Drews et al.

[11] 4,072,948

[45] Feb. 7, 1978

[54] LIGHT WEIGHT RADAR REFLECTOR

[75] Inventors: William A. Drews, Bethesda, Md.; Charles L. Padgett, Alexandria; Ray Anthony Pinna, Woodbridge, both of Va.

[73] Assignee: The United States of America as represented by the Secretary of the Army, Washington, D.C.

[21] Appl. No.: 761,553

[22] Filed: Jan. 24, 1977

[51] Int. Cl.[2] ..... H01Q 15/18
[52] U.S. Cl. ..... 343/18 C
[58] Field of Search ..... 343/18 C

[56] References Cited

U.S. PATENT DOCUMENTS

| | | | |
|---|---|---|---|
| 2,452,822 | 11/1948 | Wolf | 343/18 C |
| 2,823,376 | 2/1958 | Baldwin et al. | 343/18 C |
| 2,885,670 | 5/1959 | Kirgan | 343/18 C |
| 2,912,687 | 11/1959 | Leonard | 343/18 C |
| 3,806,927 | 4/1974 | Lane | 343/18 C |

*Primary Examiner*—T.H. Tubbesing
*Attorney, Agent, or Firm*—Nathan Edelberg; Jeremiah G. Murray; Frank J. Dynda

[57] ABSTRACT

An array of eight trihedral corner reflectors arranged to be suspended beneath a balloon such that they aim into the eight quadrants of a three-dimensional coordinate system aligned vertically and equipped with a set of vanes which cause it to rotate when ascending.

4 Claims, 3 Drawing Figures

LIGHT WEIGHT RADAR REFLECTOR

The invention herein described may be manufactured and used by or for the Government of the U.S. of America for governmental purposes without the payment of any royalties thereof or therefor.

BACKGROUND OF THE INVENTION

1. Field of the Invention

This invention relates to radar reflectors and, more particularly, to a radar reflector having a scattering cross section for each of the trihedral corners of at least 530 square meters at a frequency of 9375 MHz.

2. Description of the Prior Art

Various techniques have been employed to reflect radar signals to aid in tracking balloon sondes.

Prior reflectors are heavier and occupy a greater volume than the present invention and cannot comply with the stringent packaging requirements of 600 grams maximum and a volume of 450 cubic inches.

Additionally, prior reflectors of this size and weight have a random orientation when suspended beneath a balloon and, therefore, could not generate an effective reflection of tracking signals.

An object of this invention is to provide an improved radar reflector comprising three diecut panels which can be quickly and easily assembled.

A further object is to provide a radar reflector which rotates when ascending suspended beneath a balloon.

SUMMARY OF THE INVENTION

To overcome the disadvantages of hitherto employed radar reflectors a model was built utilizing a honeycomb material manufactured by the Hexcel Corporation.

This material consists of two 2 mil thick aluminum sheets adhesively bonded to a honeycomb core of plastic material. The panels are about 0.175 inches thick, and have a density of about 0.81 grams per cubic inch.

Prior to assembly for flight, the reflector consists of three sheared panels, two of which have sheared slots and precut fold lines to permit them to be slot-fitted to the third panel in the orthogonal planes. The assembly is held together by means of plastic clips pushed on to the six peripheral intersections of the panels. The reflector is suspended from the balloon by a nylon lanyard assembly.

During ascent, the radar reflector is forced to spin by means of three spin vanes attached to the panels.

DESCRIPTION OF THE PREFERRED EMBODIMENT

Figure 3:
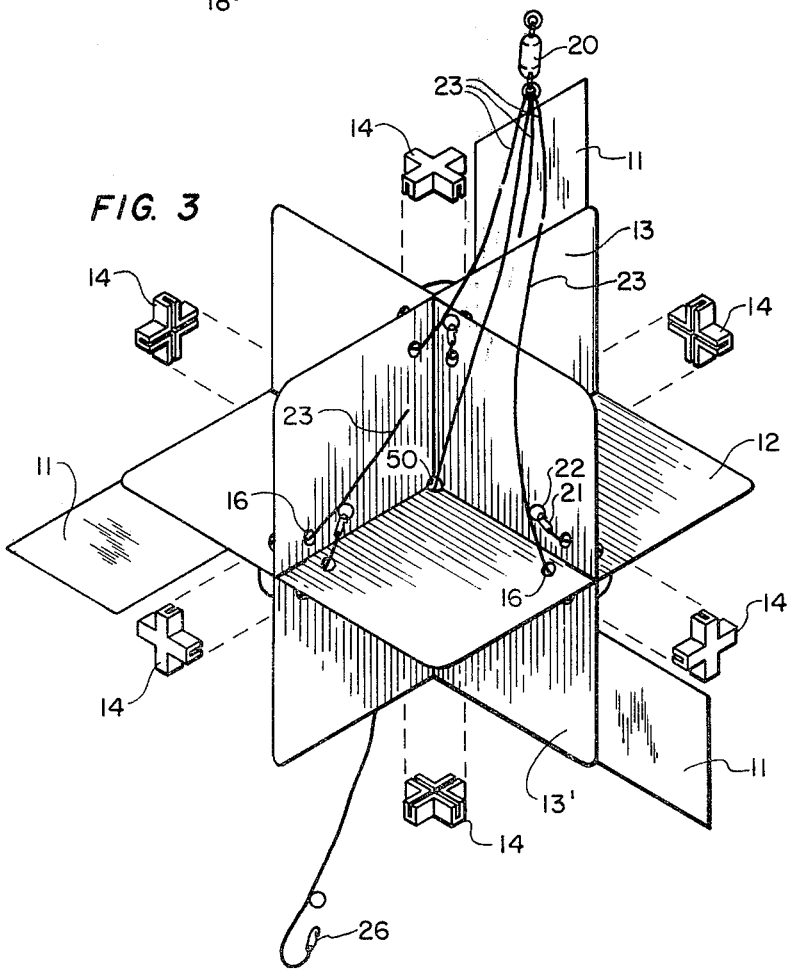
FIG. 3 is an exploded view of the radar reflector with the rotating vanes and lanyard.

Referring now to FIG. 3, the radar reflector 10 is shown suspended beneath a balloon 30 in normal operation. The reflector is an array of eight trihedral corner reflectors which are oriented such that they aim into the eight quadrants of a three-dimensional coordinate system aligned vertically when suspended beneath a balloon.

The radar reflector 10 is suspended from a swivel 20, and is equipped with three vanes 11 which cause the reflector to rotate in excess of 20 rpm when ascending at 1000 feet/minute.

The radar reflector assembly (FIG. 1) consists of three diecut panels 12, 13, and 13', six radar reflector clips 14 (FIG. 2), and a lanyard assembly 25 as shown in FIG. 3. The diecut panels consist of two layers of aluminum skin, 0.006 inches thick, adhesively bonded to a honeycomb core. The overall thickness is 0.175 inches. This material, made by Hexcel Corporation, has a very high stiffness to weight index. The reflector is made of three such panels, each 28 inches square, and exhibit a radar cross section of about 530 square meters. The reflector assembly weighs slightly less than 450 grams when assembled for flight. Packaged for shipment the reflector weighs slightly less than 600 grams and has a volume of approximately 450 cubic inches.

Diecut panel 12 is approximately 28 inches square and is slotted at four locations (15) to accept diecut panels 13 and 13' during assembly. The slots at location 15 on panel 12 are approximately 3 inches long and wide enough to tightly fit the inserted panels. The locations 15 are on the lines which run from the center of the panel 12 and intersect the midpoints of each side at right angles. Panel 12 also includes at least 4 eyeletted lanyard assembly passages (16), which are large enough to pass the lanyard ring snap 21 shown in FIG. 3.

A pair of passages 16 are included for two orthogonally adjacent slots at locations 15 on panel 12.

Figure 1:
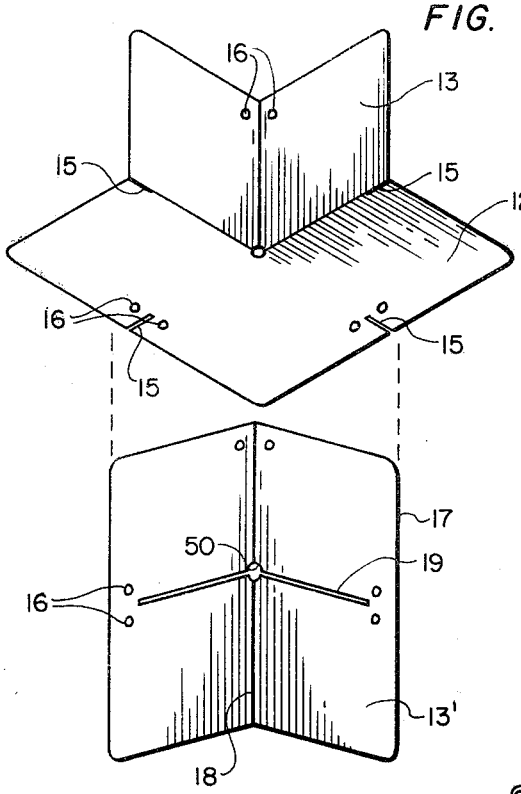
FIG. 1 shows the assembly procedure of the radar reflector panels.

Diecut panels 13 and 13' are also approximately 28 inches square. As shown in FIG. 1, panels 13 and 13' are slotted on a center line (19) of the square within approximately 3 inches of each edge (17) which slot will accept the diecut panel 12 when assembled. Panels 13 and 13' are also creased at line 18 which is at right angles to and bisects slot 19. The crease 18 enables diecut panels 13 and 13' to bend on the crease line to aid in assembly of the radar reflector. Panels 13 and 13' also include at least 6 eyeletted lanyard assembly passages (16) located as described above and as shown in FIG. 1. Diecut panel 13' is similarly assembled to panel 12 as shown in FIG. 1 with at least two eyeletted lanyard passages 16 aligned adjacent to the passages 16 of the first panel 13 assembled to panel 12 as shown in FIG. 1.

Clips 14 are pressed on the assembly as shown in FIG. 3 at the intersection points of the panels at the six peripheral intersection points. The clips 14 are cross shaped injection molded polyethylene, $1\frac{1}{2}$ inches in length, with cross slots to fit the thickness of the aluminum-core panels. The edges of the clip slots were molded with a radius to permit the fingers of the clip to slip over the edges of the reflector panels without tearing the aluminum.

Figure 2:
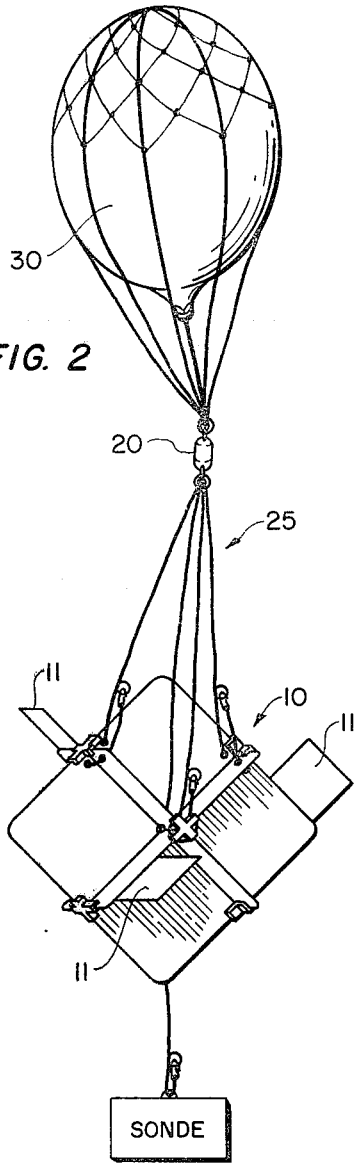
FIG. 2 is a view of the reflector suspended beneath a ballon with sonde attached.

The spin vanes 11 are about $12 \times 14$ inch rectangles. These spin vanes 11 are made of foamed polystyrene sheet, approximately one-eighth of an inch thick. They are fastened to the panels with double backed adhesive tape at the time of flight assembly. Several possible orientations of the vanes will give a spin torque to the reflector from the slipstream. In the final stages of reflector rotation rate testing, using a vertical wind tunnel designed especially for this purpose, it was found that certain orientations give a higher spin rate than others. The orientation of the spin panels shown in FIGS. 2 and 3 gives a spin rate approximately 25 to 35 rpm when ascending at 1000 feet/minute. Balloon flights have generally established the validity of this design.

As can be seen in the drawing in FIG. 3, the suspension is accomplished by feeding each end of the lanyard through four adjacent eyelet holes near a panel intersection point, then clipping the end to a small metallic ring 22 prefastened in the lanyard arm 23. This method provides a relatively simple and rapid attachment of the lanyard to the reflector while wearing mittens. This reflector aids in the tracking of the AN/AMQ-23 (XE-3) radiosonde. In addition, all diecut panels include a passageway (50) at the center to allow a sonde clip 26 to pass through the center of the reflector array as shown in FIG. 2.

The radar reflector has a scattering cross section for each of the trihedral corners of at least 530 square meters at a frequency of 9375 MHz. It is erectable without special tools and designed to be suspended from a balloon. The suspension system was equipped with swivels permitting the reflector to spin at no less than 20 revolutions per minute at an ascent rate of 1000 feet per minute. The reflector weight is 450 grams of less, and the package weight does not exceed 600 grams and a volume of 450 cubic inches.

The achievement of a radar reflector with these stringent requirements was a difficult task. Many different materials and approaches were considered. These included the stretched metalized mesh (Suchy-Reflectronics), inflatables with internal reflectors of metalized mylar, and foam core metalized mylar surfaced panels.

What is claimed is:

1. A lightweight radar reflector employed beneath a weather balloon to aid in radar tracking of a sonde comprising:

an array of eight trihedral corner reflectors;

a lanyard swivel suspension system permitting said array to swivel freely; and wherein said array of eight trihedral corner reflectors comprises:

a 1st precut panel of reflective material having a high stiffness to weight ratio in the shape of a square and having four identical slots extending from the midpoint of each edge toward the center of said panel about one-fifth the distance thereof;

a 2nd precut panel of said material of the same size and including a slot which extends from the center of said 2nd panel for a distance of about four-fifths thereof toward the midpoint of the edges of said 2nd panel along the center line, and further including a crease line along the orthogonal center line of said 2nd panel for enabling folding of said 2nd panel to an angle of about ninety degrees;

a 3rd precut panel identical to said 2nd panel, wherein said 2nd and 3rd panels are foldably affixed in a symmetrical fashion to said 1st panel by engagement of said slots;

a plurality of cross shaped clips for fastening said precut panels at the six intersection points inherent in said array;

a plurality of eyeletted lanyard passages placed so that said array will be oriented to aim said corner reflectors into the eight quadrants of a three-dimensional coordinate system aligned vertically when fastened to a lanyard assembly; and at least three spin vanes attached to said array in a symmetrical fashion to produce a spin torque when said array ascends.

2. The spin vanes as in claim 1 wherein said vanes are adhesively attached to said array.

3. An array as in claim 1 wherein said precut panels are constructed of two layers of aluminum skin adhesively bonded to a honeycomb core and wherein said array total weight is approximately 450 grams when assembled for ascent.

4. An array as in claim 1 wherein said precut panels include a central passageway for passing a lanyard clip vertically through said array for fastening to a weather sonde suspended beneath said array.

* * * * *